US005680929A

United States Patent [19]

Von Seidel

[11] Patent Number: 5,680,929

[45] Date of Patent: Oct. 28, 1997

[54] SOAP DISH

[76] Inventor: Michael Von Seidel, 5 Romajador Avenue, Sandhurst Extension 4, Sandton, Transvaal Province, South Africa

[21] Appl. No.: 678,464

[22] Filed: Jul. 3, 1996

[30] Foreign Application Priority Data

Jul. 6, 1995 [ZA] South Africa ..... 95/5624
Mar. 5, 1996 [ZA] South Africa ..... 96/1771

[51] Int. Cl.[6] ..... A47K 5/03

[52] U.S. Cl. ..... 206/77.1; D6/536; 4/628; 220/632; 248/206.3

[58] Field of Search ..... D6/525, 529, 532, D6/533, 536–540; D28/76; 4/605, 628; 206/77.1; 220/632; 248/206.3

[56] References Cited

U.S. PATENT DOCUMENTS

| | | | |
|---|---|---|---|
| D. 130,578 | 12/1941 | Dreyfuss | D6/536 |
| D. 151,211 | 10/1948 | Bradbury | D6/540 |
| D. 277,146 | 1/1985 | Boroch | D6/540 |
| 2,842,893 | 7/1958 | Howerton | 206/77.1 |
| 4,277,042 | 7/1981 | Ash, Sr. | 248/309 R |
| 4,331,232 | 5/1982 | Larkin | 206/77.1 |
| 4,621,730 | 11/1986 | Mancusi, Jr. | 206/77.1 |
| 4,993,546 | 2/1991 | Southard | 206/77.1 |
| 5,181,606 | 1/1993 | Martell | 206/77.1 |
| 5,242,064 | 9/1993 | Martell | 206/77.1 |

FOREIGN PATENT DOCUMENTS 1402789 12/1965 France .

*Primary Examiner*—Jimmy G. Foster
*Attorney, Agent, or Firm*—Arnold, White & Durkee

[57] ABSTRACT

A soap dish is provided in which the bottom of the dish is impervious and slopes downwardly at an angle of at least 3° to a front drainage discharge zone, having a lip extending downwardly below the support plane of the dish so that, in use, it extends into a sink, basin or bath. Soap support formations, conveniently rearwardly extending ribs, extend upwardly from the bottom and define at the upper ends a soap support plane inclined rearwardly towards the rear wall and spaced upwardly from the bottom. The rear wall has forwardly projecting stops, conveniently formed as extensions of soap supporting ribs to prevent direct contact between a cake of soap and the rear wall.

12 Claims, 3 Drawing Sheets

SOAP DISH

FIELD OF THE INVENTION

This invention relates to a soap dish by which term is meant a support member for a cake of soap which is available for intermittent use in the vicinity of a wash hand basin, sink, bath or other wash area.

BACKGROUND TO THE INVENTION

Cakes of soap tend to cause a problem insofar as the storage thereof in the vicinity of a wash area is concerned. If a cake of soap is not adequately drained of water applied to it during use, a zone of the cake of soap tends to become extremely soft and such soft zone may become partly attached to the support surface for the cake of soap. The balance of the soft zone is immediately lost by being washed away the next time the cake of soap is used. The result is both aesthetically displeasing insofar as soft soap remains attached to the support surface which requires that the support surface be cleaned regularly; wasteful in that it leads to a substantial waste of soap; and also distasteful to some persons who find it repulsive to touch and use a cake of soap with a soft gelatinous layer.

There is often no attempt, whatsoever, for example in at least most hotels, to provide an effective soap dish.

Where soap dishes are provided, these very often take the form of a dish, with or without one or more perforations in the bottom. In the case where no perforations are provided, the disadvantages described above apply. In the case where one or more holes are provided through the bottom of the dish, the soapy water leaks out through the hole onto the surface on which the soap dish is supported. This also leads to an aesthetically displeasing situation and also requires that the support surface be cleaned regularly.

Another attempt to overcome the formation of a soft zone in a cake of soap, and the consequent disadvantages, is the provision of a support having a series of upstanding protrusions, often conical in shape, which define at their upper ends a flat support plane for a cake of soap. Usually an identical set of protrusions extend in the opposite direction from a perforated base formed integral with the protrusions so that a cake of soap supported thereon is well clear of the support surface.

However, this arrangement, whilst maintaining a cake of soap in substantially as good a condition as possible, also has the disadvantage exhibited by the perforated soap dishes in that the soapy water draining from the soap support runs onto the support surface. This, once more, requires that the support surface be cleaned regularly. In addition, a cake of soap must be placed on such a soap support with a certain measure of care, otherwise it can slip off and possibly slide over a work top or the like, or even slip onto the floor. This is considered to be a serious draw-back of this type of soap support.

Various attempts have been made to overcome the disadvantages described above.

British Patent No. 635,527 describes a soap box having a soap draining base with ribs radiating from a central point. Drainage takes place towards two opposite sides of the base thereby giving rise to the same difficulties as are outlined above.

PCT Patent Application No. PCT/KR94/00076, published under the number WO95/00059 also discloses a soap box with a drainage facility which, in this case, delivers drained water to the surface on which the box is supported, towards the end of the box.

British Patent No. 614,528 on the other hand describes a soap dish for attachment to a wall using suction cups and wherein drainage outlets for water open at the front edge by way of slits in the metal and deformed drainage channels. There is, however, no fall to encourage water to drain. Also, soap supporting ribs which are inclined rearwardly, will tend to urge a cake of soap into contact with the rear wall of the dish thus setting up a site where water can become trapped between the dish surface and cake of soap. A gelatinous zone on the soap can thus nevertheless develop in this site. The water draining from the drainage outlets simply drops onto whatever surface is beneath the soap dish and an unsightly mess can thus be created.

U.S. Pat. No. 5,253,752 to Jang discloses a soap holder for attachment to a wall and wherein a container is releasably attached to it to receive soapy water drained from a cake of soap. This expedient requires that the container and sponge located in it be periodically cleaned, a task which will undoubtedly be overlooked and result in a messy situation. Also, mounting of a soap dish to a wall may not be convenient insofar as location is concerned as a wall may not be conveniently available.

Lateral drainage of soapy water is provided for in the case of the soap dish support of U.S. Pat. No. 5,181,606 to Martell. In this case however, the structure is complicated involving the production of a plurality of parts. Also, a weighted base is required and the contact zone with the soap is too extensive.

U.S. Pat. No. 4,993,546 overcomes these difficulties to some extent, but also has failings in that soap can easily slip off the support ribs when it is carelessly placed on the dish. This is because of the low height of the rear and sidewalls of the soap dish and also the operating horizontal orientation of the support ribs. If the height of the side and rear walls is extended to prevent this, the zones are provided for trapping water between the soap surface and wall with the disadvantage identified above. Also, the so-called "trough" or chute will project unduly far into a sink or basin because of its considerable length and will undoubtedly be bumped and knocked around during use of the basin or sink.

U.S. Pat. No. 4,277,042 to Ash overcomes these disadvantages, but introduces a new difficulty in that the soap receptacle must be adhesively secured to its support surface which may not be desirable. This is in consequence of the fact that the centre of gravity of the soap is inclined to tipple the receptacle into the basin or the like.

Built-in soap dishes such as those often provided in bathrooms, showers and the like, generally do not provide any better relief and are, at least to a large extent, largely unpopular in modern times due to the fact that they are costly to install and can only be built in when major renovations or initial construction takes place. They also severely limit the susceptibility of a room to re-decoration as and when required. Built-in soap dishes are, in any event, inappropriate in the case of many types of bathroom, kitchen, laundry and other wash area design.

OBJECT OF THE INVENTION

It is an object of this invention to provide a free standing soap dish, which may be employed to overcome the disadvantages outlined above, and which will be usable in association with at least a vast majority of different washing receptacles such as wash hand basins, kitchen sinks, baths, and the like, and also vanity slab/basin combinations.

SUMMARY OF THE INVENTION

In accordance with this invention, there is provided a free standing soap dish having an imperforate bottom, a rear wall, sidewalls, an operatively forward edge and support means located in a dish support plane and adapted to support the soap dish in an approximately horizontal orientation; the imperforate soap dish bottom being located above the dish support plane and defining a drainage surface inclined downwardly from the rear wall of the soap dish to a discharge zone at the forward edge thereof where the drainage surface communicates with a downwardly directed lip terminating below the dish support plane and wherein the angle of inclination of the bottom is at least three degrees relative to said support plane; a plurality of soap support formations defining a soap support plane elevated relative to the drainage surface and inclined downwardly towards the rear wall, and wherein the soap dish is shaped so that water draining from a cake of soap supported on said soap support formations, runs onto said drainage surface towards said lip; and stop formations projecting forwardly from the rear wall of the soap dish to prevent contact between a cake of soap and such rear wall.

Further features of the invention provide for the discharge zone and lip to extend along the entire forward edge of the dish, or alternatively, along a central region of the forward edge in which case front wall sections are provided on each side of the central region; for the drainage surface to assume the form of a series of drainage channels located between upwardly directed soap support formations in the form of ribs, preferably three or four in number, adapted to support a cake of soap at the upper edges thereof; for the soap support plane to be located at least 3 mm above the drainage surface at the point of minimum distance between them; for the soap support plane to be inclined rearwardly at an angle of at least about five degrees relative to the dish support plane, and optionally at an inclination such that a wet cake of soap will tend to slide downwardly and rearwardly in the soap support plane; for the stop formations to be defined by continuations of the support ribs which extend up substantially the entire height of the rear wall; and for the soap dish to be made of plastics material either by an injection moulding process or, alternatively, by a vacuum forming or pressing process.

Still further features of the invention provide for the dish support zone to include a peripheral support zone extending at least partway around the periphery of the soap dish; and for the operative face of the dish support zones to be either formed of permanently tacky or soft friction affording plastics material or, alternatively, for the support zones to be coated with a substantially water resistant pressure sensitive adhesive or further alternatively for the soap dish to have one or more suction cups associated with its bottom in each of the latter cases for releasable attachment to ceramic ware, stoneware or other materials of which vanity slabs, wash hand basins and kitchen sinks are manufactured; for the soap dish to be made of substantially colourless translucent material such that it assumes, to some extent, the colour of this article on which it is supported; and for the soap dish to be provided with an optionally removable "bean bag" support at the rear thereof for assisting in appropriate support of the soap dish is associated with some types of wash hand basins or the like.

In one preferred form of the invention the soap support formations are a series of substantially parallel ribs elevated relative to the drainage surface which assumes the form of a series of channels between the ribs. The ribs extend from the operatively rear edge to the operatively forward edge and are inclined rearwardly. Stop members may assume the form of continuations of the ribs which pass upwardly in front of the rear wall of the soap dish.

In order that the invention may be more fully understood various different embodiments thereof will now be described with reference to the accompanying drawings.

DETAILED DESCRIPTION OF THE INVENTION WITH REFERENCE TO THE DRAWINGS

In the embodiment of the invention illustrated in FIGS. 1 to 3 and 4, a soap dish, generally indicated by numeral (1) is made of plastics material and may be manufactured by an injection moulding process, a vacuum forming process, or a press moulding process, as will be apparent from the following description of its shape.

The basic shape is defined by a rear wall (2) and two side walls (3), with there being no front wall to this particular soap dish at all.

Figure 4:
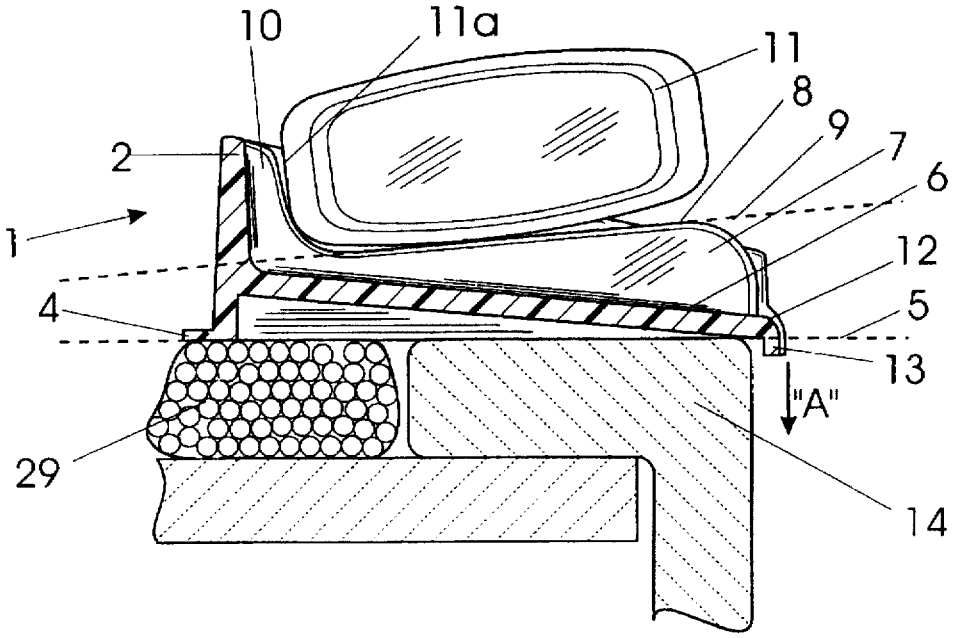
FIG. 4 is a cross-sectional view taken through the soap dish illustrated in FIG. 2 along line II to II and showing an added optional feature.

The rear wall and side walls terminate at their lower edges, in support flanges (4) which thereby define the support zones for the soap dish and which, in turn, define the support plane (5) (see FIG. 4).

Extending forwardly from the rear wall (2) are a series, in this case five, downwardly inclined drainage channels (6) which define the drainage surface and form the bottom of the soap dish. The bottom of the drainage channels is inclined at about 5 degrees to the support plane. The channels are formed between upwardly extending ribs (7) the upper edges (8) of which define the soap support formations and the soap support plane.

Figure 1:
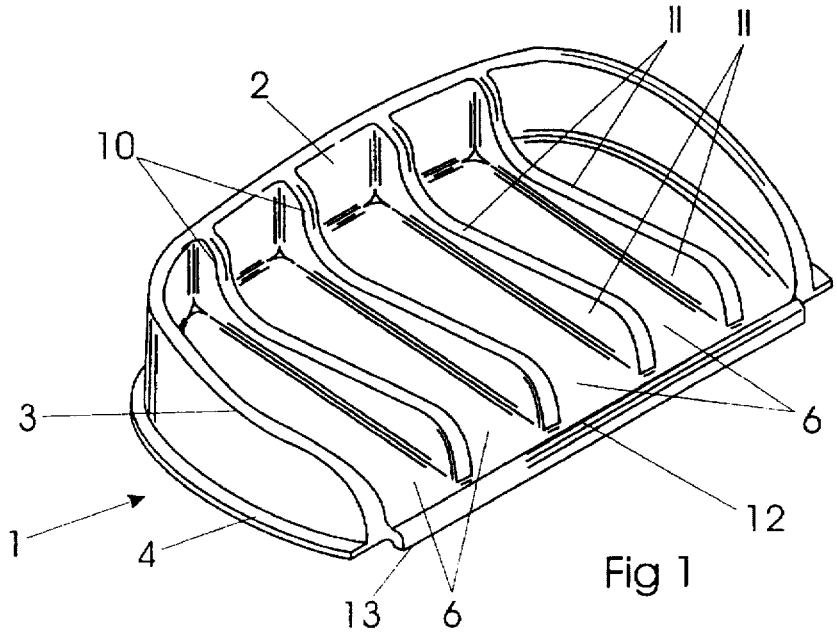
FIG. 1 is a perspective view of one embodiment of the invention.
Figure 2:
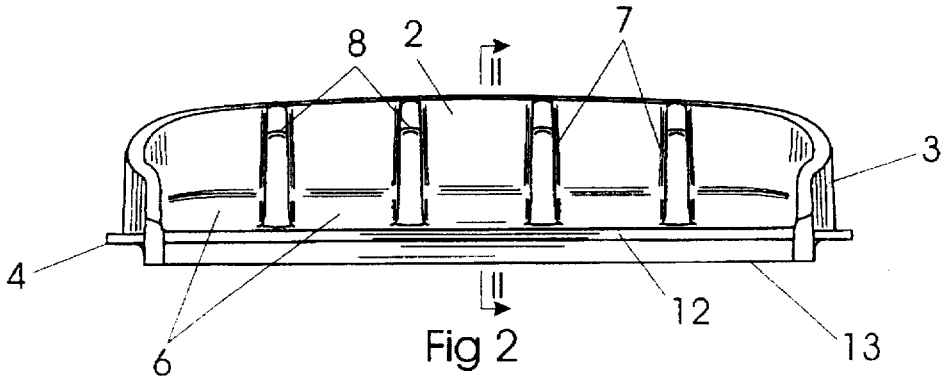
FIG. 2 is a front elevation thereof.
Figure 3:
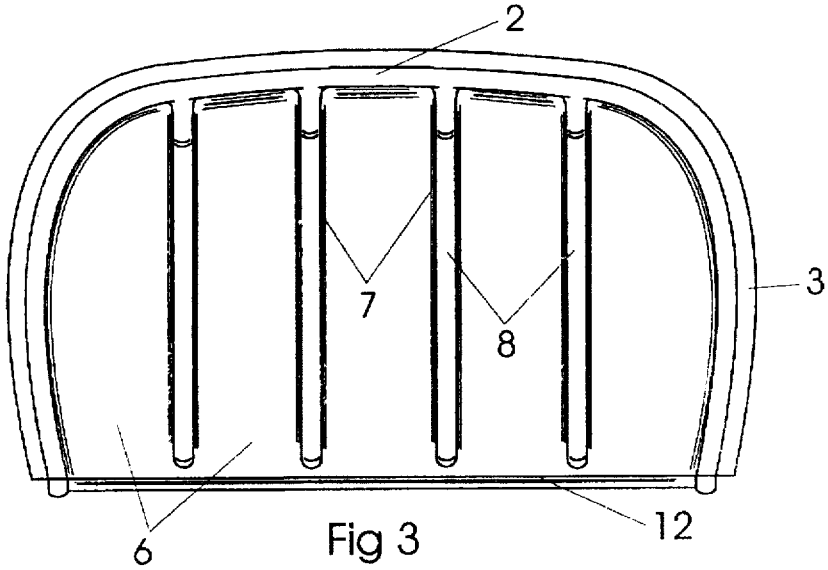
FIG. 3 is a plan view thereof.

As shown most clearly in FIG. 1 the soap support plane, indicated by numeral (9) (see FIG. 4), is inclined downwardly towards the rear wall (2) and preferably at an angle of at least about five degrees, and possibly appreciably more, to the support plane (5). Thus the soap support plane is inclined at at least about ten degrees to the bottom of the drainage channels. Also the soap support plane is located at least 3 mm above the bottom of the drainage channels at its nearest point thereto.

The ribs (7) merge, at the rear ends thereof, with forwardly projecting stop ribs (10) projecting forwardly from the rear wall (2). This is most clearly shown in FIGS. 1 and 4. The inclination of the soap support plane (9) is preferably chosen, in any event, such that a cake of soap (11), when placed on the ribs, will tend to slide rearwardly so that the rear edge (11*a*) of the cake of soap will engage the stop ribs (10).

It will be understood that, a cake of soap supported on soap dish as described above, will have no areas thereof which can form any appreciable size of soft zone to the soap and the soap will be drained effectively in consequence of water thereon running off, down the sides of the ribs, into a drainage channel (6) and then downwardly to the front edge (12) of the soap dish. This front edge is provided with a downwardly directed lip (13) extending below the dish support plane (5) so that, when the soap dish is positioned on the edge (14) of a sink, wash hand basin or the like (see FIG. 4) water draining from the soap dish will drain over the edge of the basin or sink as indicated by arrow "A" in FIG. 4.

It will be understood that the angles of inclination of the drainage surface and the soap support plane can be varied widely and, indeed, these support planes need not be flat planes. They could be dished or otherwise contoured provided that the vast majority of the face of each plane is inclined or otherwise orientated in a suitable orientation.

Figure 5:
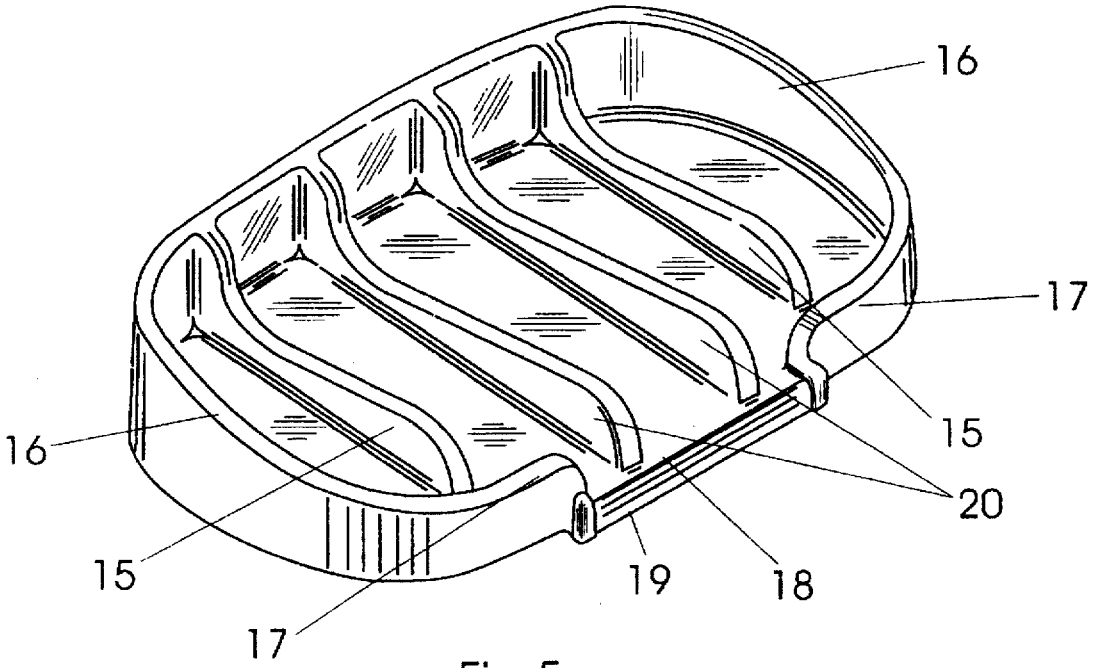
FIG. 5 is a view similar to FIG. 1 but of an alternative embodiment of the invention.

One alternative form of the invention is illustrated in FIG. 5. In this case the two outer ribs (15) i.e. those nearer the sidewalls (16) are terminated short and a short section of front wall (17) is provided on each side of a central zone (18) forming the discharge zone. In this case the lip (19) is substantially narrower and this embodiment of the invention is particularly useful where a sink or wash hand basin has a curvature in plan view in the location where the soap dish is to be located. The straight lip section, which projects into the basin, being shorter in this case, requires that the soap dish project less into the basin in order that the lip can form a cord across the curved periphery of the basin or sink.

The central ribs (20) may also be terminated short of the front edge particularly in cases where the width of the discharge zone (18) is made particularly narrow. This facilitates cleaning and also drainage from the channels adjacent the sidewalls.

In addition, in this variation of the invention, the flange is omitted and the support zones of the soap dish are defined by the lower edges of the rear wall, side walls, and where applicable, the front walls.

Figure 6:
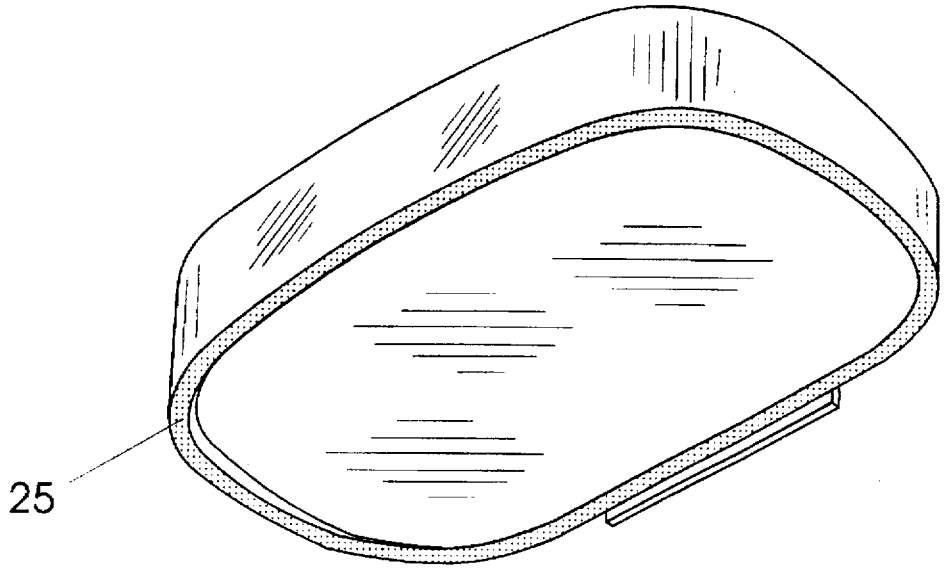
FIG. 6 is an underneath isometric view of a soap dish according to the invention.

Referring now to FIG. 6, one variation which could be applied to any of the embodiments of the invention described above, is that the face of the support zones could be provided with a layer (25) of suitable water resistant pressure sensitive adhesive which would be chosen not to adhere too strongly to any material from which vanity slabs, wash hand basins or kitchen sinks are made. Of course it is perfectly possible to permanently bond a soap dish of this nature in position, if required.

Figure 7:
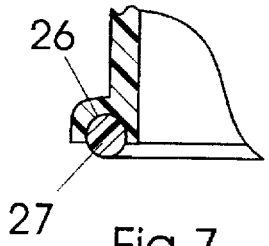
FIG. 7 is a cross-sectional view taken through an alternative form of support zone of a soap dish according to the invention.

As a further alternative, and as illustrated in FIG. 7, the support flange or rim (26) could assume the form of a channel shaped formation which receives a bead (27) of permanently tacky plastics material to enable the soap dish to be removably fixed in its operative position as and when required.

Figure 8:
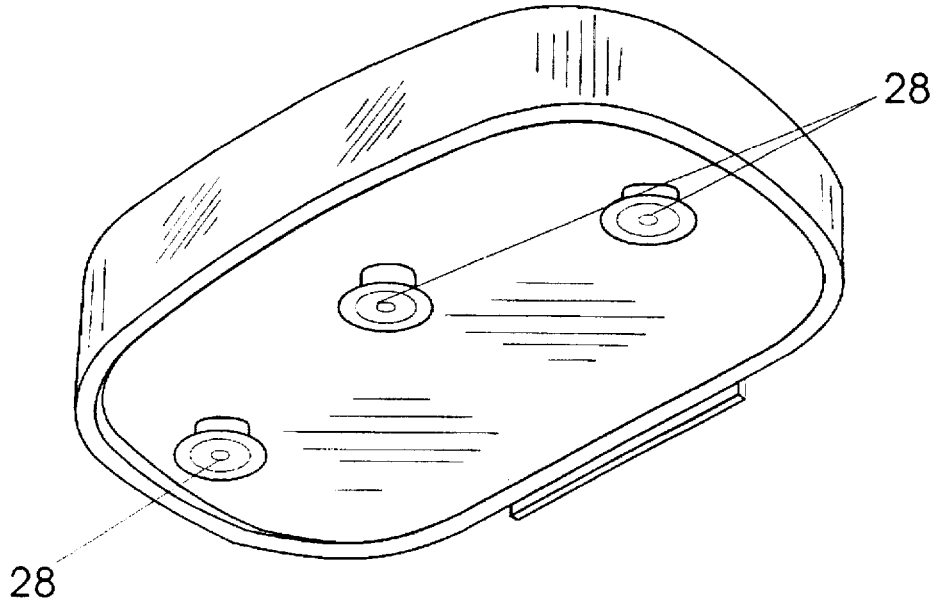
FIG. 8 is a view similar to FIG. 6, but utilising suction cups to operatively anchor the soap dish.

A still further alternative is shown in FIG. 8 in which case the soap dish is made of a firm but resiliently flexible plastics or rubber material in which case suction cups (28) for locating the soap dish are moulded integral with the dish.

It is a particularly preferred variation of the invention for the soap dish to be made of a colourless, optionally slightly milky and translucent plastics material such that the soap dish will assume the general colouration of the surface on which it is located, thereby providing a particularly aesthetically pleasing, yet totally functional, soap dish.

Also, for use in basins having a narrow rim, the rear of the soap dish could be supported by an attached bean bag type of support (29). (See FIG. 4).

It will be understood that a soap dish according to this invention can be made in all different qualities and, it is envisaged, that the invention will be particularly well suited to application in hotels where very inexpensive, thin, plastics material can be vacuum formed to form soap dishes of the nature described above. These soap dishes could be so inexpensive as to be regarded as disposable, at least from the point of view that such articles often tend to be stolen.

The invention therefore provides a simple yet highly effective soap dish which obviates the disadvantages outlined in the preamble hereto.

What I/we claim as new and desire to secure by Letters Patent is:

1. A free standing soap dish having an imperforate bottom, a rear wall, sidewalls, an operatively forward edge and support means located in a dish support plane and adapted to support the soap dish in an approximately horizontal orientation; the imperforate soap dish bottom being located above the dish support plane and defining a drainage surface inclined downwardly from the rear wall of the soap dish to a discharge zone at the forward edge thereof where the drainage surface communicates with a downwardly directed lip terminating below the dish support plane and wherein the angle of inclination of the bottom is at least three degrees relative to said support plane; a plurality of soap support formations defining a soap support plane elevated relative to the drainage surface and inclined downwardly towards the rear wall, and wherein the soap dish is shaped so that water draining from a cake of soap supported on said soap support formations, runs onto said drainage surface towards said lip; and stop formations projecting forwardly from the rear wall of the soap dish to prevent contact between a cake of soap and such rear wall.

2. A soap dish as claimed in claim 1 in which the discharge zone and lip extend along the entire forward edge of the dish.

3. A soap dish as claimed in claim 1 in which the discharge zone and lip extend along a central region of the forward edge in which case front wall sections are provided on each side of the central region.

4. A soap dish as claimed in claim 1 in which the drainage surface assumes the form of a series of drainage channels located between upwardly directed soap support formations in the form of ribs adapted to support a cake of soap at their upper edges which define the soap support plane.

5. A soap dish as claimed in claim 4 in which the stop formations are defined by continuations of the support ribs and extend up the entire height of the rear wall.

6. A soap dish as claimed in claim 1 in which the soap support plane is located at least 3 mm above the drainage surface at the point of minimum distance between them.

7. A soap dish as claimed in claim 1 in which the soap support plane is inclined rearwardly at an angle of at least about five degrees relative to the dish support plane.

8. A soap dish as claimed in claim 1 in which the dish is a plastics injection moulding.

9. A soap dish as claimed in claim 8 in which the plastics injection moulding is of a firm, resiliently deformable plastics material and one or more suction cups for operatively locating the soap dish are moulded integral therewith.

10. A soap dish as claimed in claim 1 in which the dish is vacuum formed from sheet material.

11. A soap dish as claimed in claim 1 in which the support zone is defined by a bead inserted in a groove formed in the underside of the soap dish.

12. A soap dish as claimed in any one of the preceding claims in which the dish is made of substantially colourless, translucent material.

* * * * *